US007077645B2

(12) United States Patent
Vangilbergen et al.

(10) Patent No.: US 7,077,645 B2
(45) Date of Patent: Jul. 18, 2006

(54) ROTARY TUBULAR KILN

(75) Inventors: Gaston F. V. Vangilbergen, Gelsenkirchen (DE); Harry F. Werner, Essen (DE)

(73) Assignee: VTA Verfahrenstechnik und Automatisierung GmbH, Gelsenkirchen (DE)

( * ) Notice: Subject to any disclaimer, the term of this patent is extended or adjusted under 35 U.S.C. 154(b) by 0 days.

(21) Appl. No.: 10/774,159

(22) Filed: Feb. 6, 2004

(65) Prior Publication Data

US 2005/0106523 A1 May 19, 2005

(30) Foreign Application Priority Data

Feb. 8, 2003 (DE) ..... 103 05 147

(51) Int. Cl.
*F27B 7/24* (2006.01)

(52) U.S. Cl. ..... 432/115; 277/391

(58) Field of Classification Search ..... 432/115, 432/103, 107; 277/358, 390, 391, 590
See application file for complete search history.

(56) References Cited

U.S. PATENT DOCUMENTS

| | | | | |
|---|---|---|---|---|
| 4,728,289 | A | 3/1988 | Samera, Jr. | |
| 4,804,195 | A * | 2/1989 | Parker | 277/419 |
| 4,961,588 | A * | 10/1990 | Brienza | 277/545 |
| 5,173,045 | A * | 12/1992 | Macri | 432/115 |
| 5,263,724 | A * | 11/1993 | Hansen et al. | 277/377 |
| 5,383,672 | A * | 1/1995 | Cornelius | 277/553 |
| 5,769,428 | A * | 6/1998 | Rypalla | 277/350 |

FOREIGN PATENT DOCUMENTS

| | | |
|---|---|---|
| DE | 1451551 | 9/1963 |
| DE | 3236561 | 9/1982 |
| JP | 10300358 | 11/1998 |

* cited by examiner

*Primary Examiner*—Gregory Wilson
(74) *Attorney, Agent, or Firm*—Fay, Sharpe, Fagan, Minnich & McKee, LLP

(57) ABSTRACT

A longitudinal sealing (20), which, as a rule, extends below the rotating tube (30), is proposed to increase the heating efficiency in a rotary tubular kiln, in which a rotating tube (30) is surrounded, like a bowl, by heating tunnel (32) and is indirectly heated by a heating medium. It is designed in the shape of a separation wall between the entry side (38) and the exit side (40) for the heating medium in the heating tunnel and consists of a rigid part (22) and a flexible part (24), situated thereon and adaptable to the rotating tube profile.

22 Claims, 2 Drawing Sheets

ROTARY TUBULAR KILN

The invention under consideration refers to a rotary tubular kiln with a longitudinal sealing within a bowl-shaped heating tunnel surrounding a rotating tube which can be heated from the outside according to the preamble of claim 1, and a method for the production of such a longitudinal sealing according to the preamble of claim 7.

BACKGROUND OF THE INVENTION

In rotary tube kilns, high temperatures are usually used. The rotating tube can, to this end, be heated indirectly to the desired temperature with a heating medium (such as hot gas or hot air), in order to reach, in the interior of the rotating tube, the sufficiently high temperatures (several 100° C., in part >1000° C.) for chemical processes or other desired processes taking place therein. To this end, the rotating tube is usually surrounded by a heating tunnel, as shown, schematically, in FIG. 1, which shows a schematic cross-section through a rotary tubular kiln, according to the state of the art. The heat tunnel 12, surrounding like a housing the rotating tube 10 which turns in the direction of the arrow C (or in the opposite direction), has several burners 14 on its entire length, which indirectly heat the rotating tube, and gas outlets 16. A heating medium, such as hot gas, is introduced through the gas inlets 14A; the medium flows around the circumference of the rotating tube (also called rotating drum) and thus heats it. The gas can flow around both the underside of the rotating tube (as shown by arrow A) as well as the upper side (as shown by arrow B).

The efficiency of the kiln is much greater by providing a flow of heating medium along the upper side of the rotating tube. The kiln efficiency is increased because the residence time of the gas along the surface of the rotating tube is increased and thus more time is provided for heat exchange. Moreover, flow of heating medium along the upper side results in exposure of a larger surface fraction of the rotating tube to the flow of heating medium, i.e. hot gas. Since it is possible for a portion of the gas, however, to flow around the underside of the rotating tube, a loss in efficiency occurs. This results since with such a flow pattern, the heat exchange is clearly less. A loss in efficiency and reduction in heat transfer also occurs if a narrow passage is provided in the form of a slit D along the underside of the rotating tube. In this case, the flow of heating medium would move along arrow A'.

The rotating tube in FIG. 1 is shown circular, schematically. This does not correspond to reality however. Since such a rotating tube extends over several meters, in part up to 100 m, it is technically almost impossible to guarantee a completely round profile over this entire distance. Furthermore, the rotating tube has a certain imbalance.

THE INVENTION

Therefore, the problem is to create a rotary tubular kiln, which guarantees a more efficient heat exchange with outside heating, taking into consideration the described characteristics of the rotating tube.

To solve this problem a rotary tubular kiln with the features of claim 1 is proposed. Accordingly, the invention is based on the basic idea of creating a longitudinal sealing, preferably extending below the rotating tube, for a rotary tubular kiln, in which a rotating tube is surrounded bowl-like by a heating tunnel; the sealing has a rigid part and a flexible part. In this way, the flow around both sides with the heating medium—that is, an almost complete thermal short circuit—if not actually complete—is prevented. The flexible part of the longitudinal sealing, which preferably lies constantly against the rotating tube, is able to adapt to the imbalance and/or profile change of the rotating tube and thus to generate an essentially impermeable longitudinal sealing of the rotating tube for the heating tunnel wall. This longitudinal sealing has a particularly favorable effect on the heat passage through the rotating tube wall, since it constantly experiences a brush-like cleaning. Such a longitudinal sealing can be produced by the method described in claim 7.

By means of a rotary tubular kiln, designed in accordance with the invention, it is possible, among other things, to lower the needed temperature difference between the temperature of the heating medium and the desired interior temperature of the rotating tube, since now the heat exchange takes place with a higher efficiency. Thus, there is a savings in energy. On the other hand, the rotating tube experiences less thermal load. Also, new possibilities arise from this in the selection of the kiln wall material.

The aforementioned and the claimed components, to be used in accordance with the invention and described in the embodiments, are subject to no special exceptional conditions in their size, shaping, material selection, and technical constellation, so that the selection criteria known in the application domain can be used without reservation.

Other details, features, and advantages of the object of the invention can be deduced from the dependent claims and (except for FIG. 1) from the following description of the pertinent drawings, in which—by way of example—embodiments of the rotary tubular kiln, in accordance with the invention, are shown.

The figures in the drawings show the following:

PREFERRED EMBODIMENT

Figure 1:
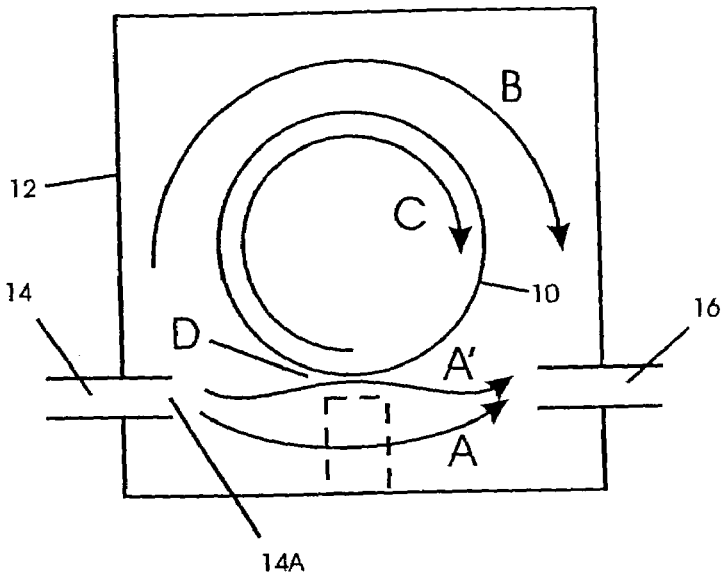
FIG. 1, an indirectly heated rotary tubular kiln, according to the state of the art, in schematic cross-sectional view.
Figure 2:
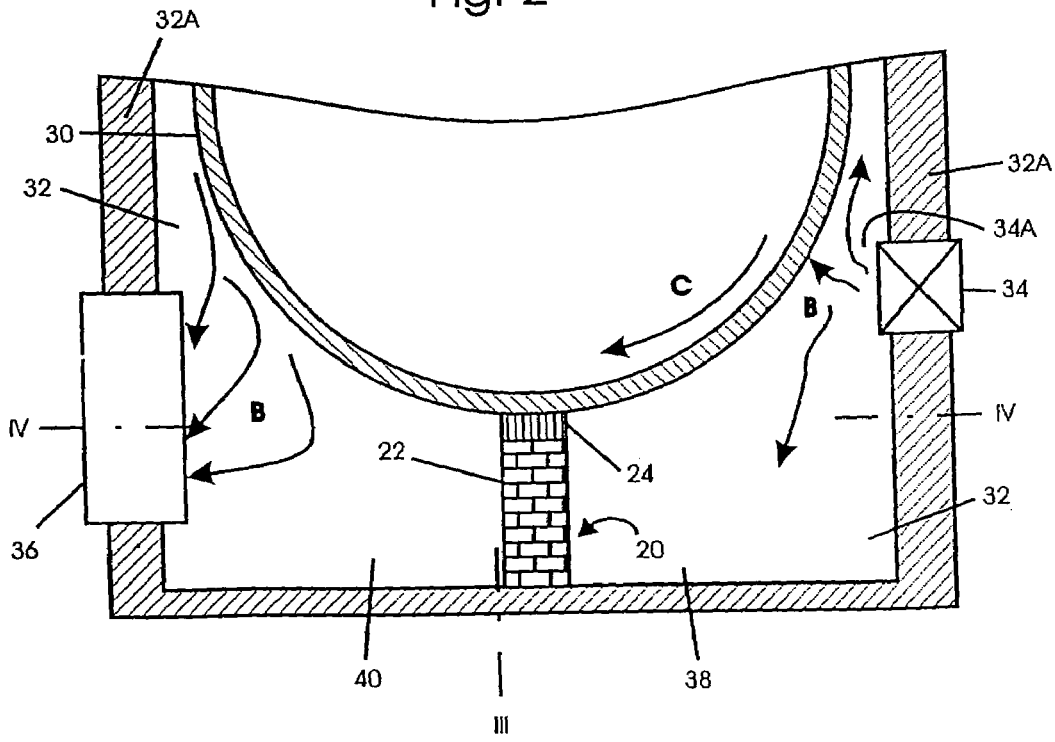
FIG. 2, a rotary tubular kiln, in accordance with the invention in vertical view, along line II—II according to FIG. 4, schematically.
Figure 4:
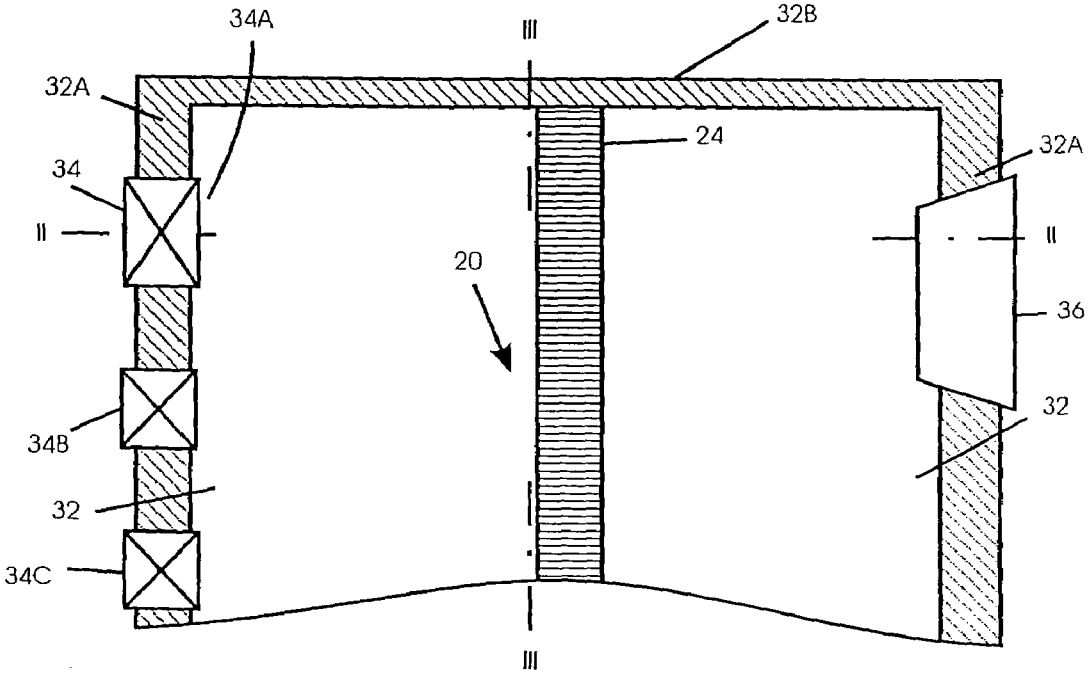
FIG. 4, the same rotary tubular kiln, in horizontal section, along the line IV—IV, according to FIG. 2 (in section).

Referring to FIG. 2, in accordance with the present invention, a rotary tubular kiln is provided, comprising a rotating tube 30, which can rotate within an approximately bowl-shaped, surrounding, stationary heating tunnel 32. The heating tunnel surrounds the rotating tube, preferably along a substantial portion of the length of the heating tunnel. The heating tunnel wall 32A defines at least one inlet 34 for a heating medium such as hot air or hot gas, and at least one outlet 36. The inlet and outlet are, as shown in FIG. 4, and in this respect, preferably shaped as relatively long recesses or openings of the heating tunnel, and arranged on the side walls that form the tunnel. The inlet and outlet can also be in the form of connections or tubes provided in a tunnel wall.

Usually, the rotating tube receives a flow of heating medium on its circumference and its entire length. The essential direction of flow of the heating medium is thereby in the direction of flow arrows B—that is, perpendicular to the rotating tube axis. The heating can take place both in, as well as contrary to, the rotating direction.

Figure 3:
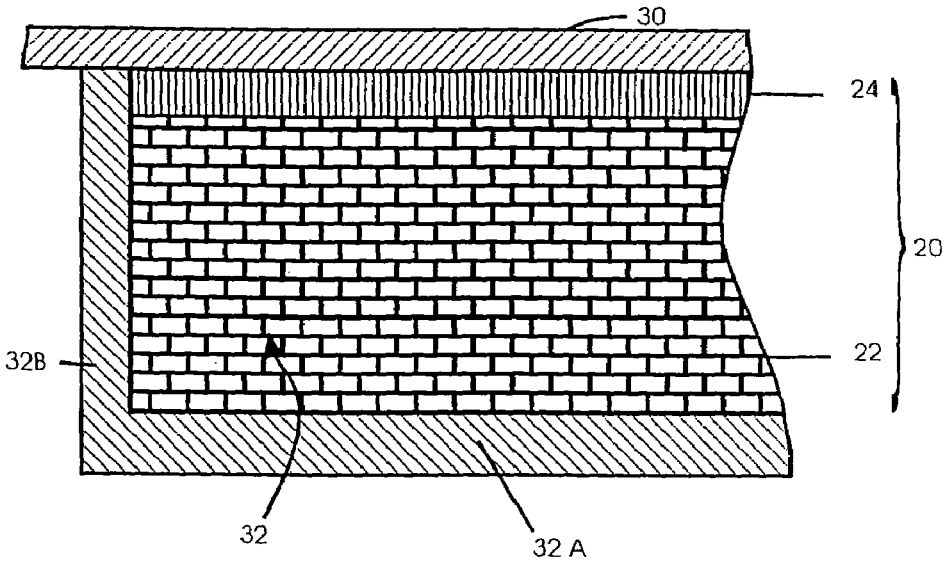
FIG. 3, the same rotary tubular kiln, in vertical section, along line III—III according to FIG. 2 (in section)

Usually, the heating tunnel 32, formed between the tunnel wall 32A and rotating tube 30, is sealed off with respect to the front side—among other things, in order to prevent an escape of the heating medium except through the outlet 36 (FIG. 3). The rotating tube can be completely surrounded by the heating tunnel or also laterally project over it.

The longitudinal sealing 20 is essentially found below the rotating tube. It looks like the embodiment according to FIGS. 2–4 and in this respect, preferably as a separation wall between the entry side 38 and the exit side 40 of the heating tunnel 32. The longitudinal sealing 20 consists of a rigid part 22 and a flexible part 24 found thereon. In the simplest case, the longitudinal sealing 20 consists of a flat, long wall with one or more flexible sealing elements placed thereon. The wall preferably extends along the full length of the heating tunnel 32 and joins the front walls 32B of the same, as can be seen from FIGS. 3 and 4. Thus, a front-side flowing around of the longitudinal sealing by the heating medium is prevented.

As indicated in FIG. 2, the longitudinal sealing 20 in this embodiment can have a width of approximately 10–20% of the diameter of the rotating tube. The width of the longitudinal sealing, however, can also be selected smaller or larger, depending on the requirement.

The rigid part 22 preferably consists of brickwork. However, any other rigid or refractory material, which withstands the temperatures that appear in the heating tunnel can be taken into consideration also. As indicated in FIG. 2, the rigid part 22 can extend near the rotating tube 30 as long as it is not seized by it when the rotating tube turns. In building the rigid part, one should be aware that the rotating tube will not rotate precisely during the operation of the kiln because of the previously described lack of precision in the rotating tube profile and because of imbalances.

The flexible part 24 is found on the rotating tube-side end of the rigid part 22. It is preferably made of a material which is so flexible that it is adapted to the inaccuracies of the rotating tube profile when the rotating tube turns. Moreover, it should withstand the temperatures which appear within the heating tunnel. Preferably, the flexible part is predominantly made of ceramic fibers.

FIGS. 3 and 4 show various views of a preferred longitudinal sealing. As can be seen from these figures, the flexible part preferably consists of strips and/or strip packets of a flexible material joined to one another. They are preferably placed at a right angle to the rotating tube axis, which requires a certain minimum thickness of the longitudinal sealing 20. This arrangement guarantees, on the one hand, an improved sealing and, on the other hand, a higher service life of the sealing. To increase the tightness, the individual strips and/or strip packets can also be cemented with one another or otherwise affixed to one another. The flexible part 24 is preferably produced by pressing in individual strips and/or strip packets between the rigid part 22 and the rotating tube 30. Depending on the need, it is connected with the rigid part 22, as, for example, by cementing. As particularly preferred, the individual strips and/or strip packets are compressed vertically and in their stacking direction. This guarantees that the sealing functions satisfactorily even after long operation and a corresponding wear. Furthermore, this prevents individual parts of the longitudinal sealing from being removed from their specific position by the rotating movement of the rotating tube.

As shown in FIG. 4 and in this respect preferred, several burners 34 can be opposite only one gas outlet 36, as is known from the state of the art. In this case, the direction of flow of the heating medium, which escapes from the burners 34C, at a distance from the gas outlet, will take place not only along the circumference of the rotating tube but rather also diagonally, in the direction of the gas outlet 36. A longitudinal sealing, in accordance with the invention, has a particularly favorable effect here, because in this way, it can be guaranteed that a substantial part of the heating medium flows around the rotating tube at least until it reaches the upper side of the rotating tube, instead of immediately being suctioned in the direction of the gas outlet 36 because of the diagonal flow.

In a preferred embodiment, the strip packet consists of 25 mm-thick ceramic fiber mats which are at least 75 mm high and approximately 34.5 cm wide (KT 1430° C.; RG ca. 200 kg per square meter), which are compressed to 20 mm. If desired, several strips can also be pressed in, as strip packets, above one another, between the rigid part 22 and the rotating tube 30. By pressing, it is possible to influence the flexibility of the flexible part 24. It is also possible to first place a somewhat less flexible ply on the rigid part 22 and on it, in turn, a more flexible material. In the same way, of course, the rigid part 22 can also consist of several plies or layers of different materials, on and/or next to one another.

However, it may also be desired for several strips, which are lying next to one another and are made of flexible material, to run parallel to the longitudinal sealing wall. This is particularly advantageous if the flexible part on the inlet side of the heating tunnel is to have other material characteristics than on the outlet side—for example, because of the different temperatures. In this case, the pressing-in process would have to be correspondingly modified. Here too, several plies of flexible material would have to be taken into consideration.

Already in its production, the flexible part is adaptable to the rotating tube outer surface in that the flexible part 24 is produced by pressing in strips and/or strip packets between the rigid part 22 and the rotating tube 30. Thus, inaccuracies and/or fluctuations in the rotating tube profile can be taken into consideration—for example, if a rotating tube has, at one site, a somewhat greater outside diameter (perhaps due to a welding seam or something similar).

LIST OF REFERENCE SYMBOLS

10 Rotating tube
12 Heating tunnel
14 Burner
14A Inlet
16 Outlet
20 Longitudinal sealing
22 Rigid part
24 Flexible part
30 Rotating tube
32 Heating tunnel
32A Heating tunnel wall
32B Heating tunnel front wall
34 Burner
34A Inlet
34B Burner
34C Burner
36 Outlet
38 Entry side of the heating medium
40 Exit side of the heating medium
A Flow arrow
A' Flow arrow
B Flow arrow
C Rotation direction
D Slit

The invention claimed is:

1. A rotary tubular kiln comprising:

a heating tunnel wall defining an interior heating tunnel;

an externally heatable, rotatable tube disposed within and generally surrounded by said heating tunnel wall, said rotatable tube defining an outer surface;

a longitudinal sealing member disposed within said interior heating tunnel, said sealing member extending between said tunnel wall and said outer surface of said rotatable tube, said sealing member positioned within said interior heating tunnel to define an entry side and an exit side of said interior heating tunnel, said sealing member including (i) a rigid portion positioned at a distance from said rotating tube, and (ii) a flexible portion positioned adjacent to said outer surface of said rotating tube.

2. The rotary tubular kiln according to claim 1 wherein said tunnel wall is bowl-shaped.

3. The rotary tubular kiln according to claim 1 wherein said sealing member is disposed below said rotatable tube.

4. The rotary tubular kiln according to claim 1, wherein said rigid portion comprises a refractory material.

5. The rotary tubular kiln according to claim 1, wherein said flexible portion comprises ceramic fibers.

6. The rotary tubular kiln according to claim 1, wherein said flexible portion includes a plurality of strips.

7. The rotary tubular kiln according to claim 6 wherein at least a portion of said plurality of strips are joined to one another.

8. The rotary tubular kiln according to claim 6 wherein said strips are formed from an elastic and compressible material.

9. The rotary tubular kiln according to claim 6, wherein at least a portion of said plurality of strips are arranged to form at least one stack of strips.

10. The rotary tubular kiln according to claim 6 wherein said plurality of strips extend generally perpendicular to the axis of rotatable tube.

11. The rotary tubular kiln according to claim 1 wherein the longitudinal sealing member extends along at least a portion of the length of the heating tunnel wall.

12. The rotary tubular kiln according to claim 1 wherein the longitudinal sealing member extends along the length of the heating tunnel wall.

13. A rotary tubular kiln comprising:

a heating tunnel wall defining an interior heating tunnel;

an externally heatable, rotatable tube disposed within and generally surrounded by said heating tunnel wall, said rotatable tube defining an outer surface;

a longitudinal sealing member disposed within said interior heating tunnel, said sealing member extending between said tunnel wall and said outer surface of said rotatable tube, said sealing member positioned within said interior heating tunnel to define an entry side and an exit side of said interior heating tunnel, said sealing member including (i) a rigid portion positioned at a distance from said rotating tube, and (ii) a flexible portion positioned adjacent to said outer surface of said rotating tube wherein said flexible portion includes a plurality of strips and said strips are joined to one another by use of a cement.

14. A method for producing a longitudinal sealing member in a rotary tubular kiln, said kiln including (i) a heating tunnel wall defining an interior heating tunnel, and (ii) a rotatable tube disposed within said interior heating tunnel, said method comprising:

forming a wall within said interior heating tunnel, said wall extending generally parallel to a longitudinal axis of said tube, said wall formed from a rigid material;

providing a plurality of flexible strips; and affixing said plurality of flexible strips to said wall such that said strips are positioned adjacent to an outer surface of said tube.

15. The method according to claim 14 wherein said plurality of flexible strips are formed from an elastic material.

16. The method according to claim 14 wherein said step of affixing said plurality of strips is performed such that after affixing, said strips extend in a direction generally perpendicular to said longitudinal axis of said tube.

17. A method for producing a longitudinal sealing member in a rotary tubular kiln, said kiln including (i) a heating tunnel wall defining an interior heating tunnel, and (ii) a rotatable tube disposed within said interior heating tunnel, said method comprising:

forming a wall within said interior heating tunnel, said wall extending generally parallel to a longitudinal axis of said tube, said wall formed from a rigid material;

providing a plurality of flexible strips;

affixing said plurality of flexible strips to said wall such that said strips are positioned adjacent to an outer surface of said tube; and joining said plurality of flexible strips to one another.

18. A method for producing a longitudinal sealing member in a rotary tubular kiln, said kiln including (i) a heating tunnel wall defining an interior heating tunnel, and (ii) a rotatable tube disposed within said interior heating tunnel, said method comprising:

forming a wall within said interior heating tunnel, said wall extending generally parallel to a longitudinal axis of said tube, said wall formed from a rigid material;

providing a plurality of flexible strips; and affixing said plurality of flexible strips to said wall such that said strips are positioned adjacent to an outer surface of said tube wherein said step of affixing is performed by pressing said strips within said wall.

19. A method for producing a longitudinal sealing member in a rotary tubular kiln, said kiln including (i) a heating tunnel wall defining an interior heating tunnel, and (ii) a rotatable tube disposed within said interior heating tunnel, said method comprising:

forming a wall within said interior heating tunnel, said wall extending generally parallel to a longitudinal axis of said tube, said wall formed from a rigid material;

providing a plurality of flexible strips; and affixing said plurality of flexible strips to said wall such that said strips are positioned adjacent to an outer surface of said tube wherein said step of affixing said plurality of strips is performed such that after affixing, said strips extend in a direction generally perpendicular to said longitudinal axis of said tube, and said strips are also compressed in a direction generally parallel to said longitudinal axis of said tube.

20. A rotary tubular kiln comprising:

a heating tunnel wall defining an interior heating tunnel;

an externally heatable, rotatable tube disposed within and generally surrounded by said heating tunnel wall, said rotatable tube defining an outer surface;

a longitudinal sealing member disposed within said interior heating tunnel, said sealing member extending between said tunnel wall and said outer surface of said rotatable tube, said sealing member positioned within said interior heating tunnel to define an entry side and an exit side of said interior heating tunnel, said sealing member including (i) a rigid portion comprising a refractory material positioned at a distance from said rotating tube, and (ii) a flexible portion disposed on a distal end of the rigid portion and positioned adjacent to said outer surface of said rotating tube.

21. A rotary tubular kiln comprising:

a heating tunnel wall defining an interior heating tunnel;

an externally heatable, rotatable tube disposed within and generally surrounded by said heating tunnel wall, said rotatable tube defining an outer surface;

a longitudinal sealing member disposed within said interior heating tunnel, said sealing member extending between said tunnel wall and said outer surface of said rotatable tube, said sealing member positioned within said interior heating tunnel to define an entry side and an exit side of said interior heating tunnel, said sealing member including (i) a rigid portion positioned at a distance from said rotating tube, said rigid portion comprising a refractory material, and (ii) a flexible portion positioned adjacent to said outer surface of said rotating tube, said flexible portion comprising ceramic fibers and including a plurality of strips that extend generally perpendicular to the axis of said rotatable tube.

22. A rotary tubular kiln comprising:

a heating tunnel wall defining an interior heating tunnel, said tunnel wall is bowl-shaped;

an externally heatable, rotatable tube disposed within and generally surrounded by said heating tunnel wall, said rotatable tube defining an outer surface;

a longitudinal sealing member disposed within said interior heating tunnel, said sealing member extending between said tunnel wall and said outer surface of said rotatable tube, said sealing member positioned within said interior heating tunnel to define an entry side and an exit side of said interior heating tunnel, said sealing member including (i) a rigid portion positioned at a distance from said rotating tube, and (ii) a flexible portion positioned adjacent to said outer surface of said rotating tube, wherein the rigid portion comprises a brick wall and the flexible portion constitutes a crown disposed on the top of the brick wall.

* * * * *